US007011504B2

(12) United States Patent
Seo et al.

(10) Patent No.: US 7,011,504 B2
(45) Date of Patent: Mar. 14, 2006

(54) FAN, FAN GUARD AND RELATED METHOD

(75) Inventors: Jason Seo, Torrington, CT (US); Jan Najman, Harwinton, CT (US)

(73) Assignee: Nidec America Corporation, Torrington, CT (US)

( * ) Notice: Subject to any disclaimer, the term of this patent is extended or adjusted under 35 U.S.C. 154(b) by 0 days.

(21) Appl. No.: 10/407,411

(22) Filed: Apr. 4, 2003

(65) Prior Publication Data

US 2004/0197189 A1 Oct. 7, 2004

(51) Int. Cl.
*B64C 11/00* (2006.01)
*F03B 11/08* (2006.01)

(52) U.S. Cl. ..... 416/247 R; 416/247 A; 415/121.2; 415/220; 417/423.1; 417/423.15

(58) Field of Classification Search ..... 416/247 R, 416/247 A; 415/220, 223, 121.2; 417/423.1, 417/423.7, 423.15

See application file for complete search history.

(56) References Cited

U.S. PATENT DOCUMENTS

| | | | | |
|---|---|---|---|---|
| 2,043,934 A | * | 6/1936 | Spear | 415/148 |
| 2,152,112 A | * | 3/1939 | Tornberg | 416/100 |
| 2,512,159 A | * | 6/1950 | Koch | 310/91 |
| 3,402,882 A | * | 9/1968 | Militello | 415/121.2 |
| 3,963,382 A | | 6/1976 | Patton | |
| 4,365,930 A | * | 12/1982 | Ogura et al. | 416/124 |
| 4,394,111 A | * | 7/1983 | Wiese et al. | 417/423.14 |
| 4,445,426 A | | 5/1984 | Bohanon, Sr. | |
| 4,724,747 A | | 2/1988 | Sturm et al. | |
| 4,861,230 A | | 8/1989 | Breining | |
| 5,259,726 A | | 11/1993 | Bacria | |
| 5,407,324 A | | 4/1995 | Starnes, Jr. et al. | |
| 5,575,622 A | | 11/1996 | Zimmerman et al. | |
| 5,749,708 A | | 5/1998 | Matson | |
| 5,788,566 A | | 8/1998 | McAnally et al. | |
| 5,795,133 A | | 8/1998 | Hill et al. | |
| 5,944,488 A | | 8/1999 | Matson | |
| 5,951,257 A | | 9/1999 | Matson | |
| 6,071,078 A | | 6/2000 | Schlegel et al. | |
| 6,202,322 B1 | | 3/2001 | Turner, IV | |
| 6,213,718 B1 | | 4/2001 | Hill et al. | |
| 6,508,621 B1 | * | 1/2003 | Zeighami et al. | 415/211.2 |
| 2002/0057968 A1 | | 5/2002 | Lu et al. | |

FOREIGN PATENT DOCUMENTS

| | | |
|---|---|---|
| JP | 61210295 | 9/1986 |
| JP | 61223297 | 10/1986 |
| JP | 62298694 | 12/1987 |
| JP | 63045492 | 2/1988 |
| JP | 63140892 | 6/1988 |

* cited by examiner

*Primary Examiner*—Theresa Trieu
(74) *Attorney, Agent, or Firm*—McCarter & English, LLP

(57) ABSTRACT

An assembly includes a fan housing that includes a casing and a stator disposed radially inward of the casing and adapted to receive a rotor assembly. Struts attach the stator to the casing. One or more of the struts may define a channel for routing one or more electrical wires. A fan guard helps prevent accidental contacting of the fan blades. The fan guard may be mounted to the struts and may be flush with the housing, and/or may be adapted to cover at least a portion of the channel, thereby trapping the electrical wire(s) in the channel.

27 Claims, 4 Drawing Sheets

FAN, FAN GUARD AND RELATED METHOD

TECHNICAL FIELD

This invention relates to electric fans and fan guards, and to methods for mounting such guards.

BACKGROUNDS OF THE INVENTION

Many systems employ fans to move air (or some other fluid). For example, desktop and laptop computers, as well as many other types of electronic systems, often have internal electric fans that generate air flow to help cool internal components (e.g., the hard drive, integrated circuits, power supply, etc.).

In an electric fan, airflow is produced by a plurality of rotating fan blades, which are in turn driven by an electric motor. The motor and blades are usually supported by a stator, which in turn may be supported by struts coupled to an outer casing.

As might be expected, it is generally desirable to prevent accidental contacting of the fan blades. Fan guards have been developed for this purpose. At present, the design of fan guards is addressed by numerous national and international safety standards.

In many systems, it is generally desirable to provide a fan guard that does not unduly impede the airflow (or other fluid flow).

In addition, it is often desirable to be able to provide a guard that is flush with the housing so as not to increase the dimensions of the fan. One method of not increasing the dimensions is to fasten the guard to the inner surfaces of the fan housing, for example, as disclosed in U.S. Pat. Nos. 5,951,257 and 5,749,708.

One drawback associated with this method is that the fastening hardware is more complex than desired. Another drawback is that the fastening hardware can impede the airflow (or other fluid flow) more than desired.

Another method to provide a guard that is flush with the housing is to form the housing with an integral fan guard.

However, the tooling required to form the housing with an integral fan guard is often more complex than desired. Another drawback associated with integral guards is that national and international safety standards can differ from one another and are subject to change. Consequently, a manufacturer would need to have a variety of housing designs in order to address each potential set of guard requirements.

It is also generally desirable to prevent the electrical wires of the fan from getting into the path of the rotating fan blades. One conventional method involves clipping the wires to structural members of the fan housing.

One drawback associated with this method is that the use of clips adds cost and labor to the system.

Accordingly, it is an object of the present invention to provide fan guards and methods for mounting such guards that overcome one or more of the above described drawbacks of the prior art.

SUMMARY OF THE INVENTION

According to a first aspect of the present invention, an assembly includes a fan housing that includes a casing and a stator, the stator being disposed radially inward of the casing and adapted to receive a rotor assembly. A strut attaches the stator to the casing. The assembly further includes a guard that engages the stator to retain the guard to the strut to help retain the guard to the fan housing.

According to another aspect of the present invention, an assembly includes a fan housing that includes a stator, a casing, and a strut that attaches the stator to the casing. The assembly further includes a guard having means for engaging the strut to help retain the guard to the fan housing.

According to another aspect of the present invention, a method is provided for use in association with a fan housing that includes a stator, a casing, and a strut that attaches the stator to the casing. The method includes providing a fan guard and retaining the guard to the strut.

According to another aspect of the present invention, an assembly includes a fan housing that includes a casing, a stator, and a strut having a radially extending channel with at least one electrical wire routed therethrough. The assembly further includes a guard that includes a surface that covers at least a portion of the channel when the guard is mounted to the fan housing, thereby trapping the electrical wire(s) in the channel.

According to another aspect of the present invention, an assembly includes a fan housing that includes a casing, a stator, and a strut having a radially extending channel with at least one electrical wire routed therethrough. The assembly further includes a guard that includes means for trapping the electrical wire(s) in the channel when the guard is mounted to the fan housing.

According to another aspect of the present invention, a method includes providing a fan housing that includes a stator, a casing, and a strut having a radially extending channel. The method further includes routing at least one electrical wire through the channel and covering at least a portion of the channel with a guard mounted to the housing to thereby trap the electrical wire in said channel.

According to another aspect of the present invention, a fan guard for a fan housing that includes a stator, a casing, and a strut that attaches the stator to the casing is provided. The fan guard includes a grill and a clip that extends radially, wherein the clip is adapted to engage the strut to retain the guard to the strut.

It should be understood that the various aspects of the present invention may be employed individually and/or in any combination thereof.

One advantage of the currently preferred embodiments of the present invention is that the guard is snapped to a strut that supports the stator. Snapping the guard to an existing structure helps minimize any impact to airflow.

Another advantage of the currently preferred embodiments is that the guard may be made flush with the housing, so as not to increase the dimensions of the fan.

Another advantage of the currently preferred embodiments is that there is no need for the complex tooling that would be needed to fabricate a housing with an integral guard.

Furthermore, because the guard is formed separate from the housing and then mounted thereto, differing sets of customer guard requirements can be met by merely providing different guards. Thus, there is no need to have a different housing design for each potential set of guard requirements.

Another advantage of the currently preferred embodiments is that the electrical wires are retained without the need for clips, thereby eliminating the cost and labor normally associated with the use of clips.

Other advantages of the present invention will become apparent in view of the following detailed description of preferred embodiments, claims, and accompanying drawings.

DETAILED DESCRIPTION

Figure 1:
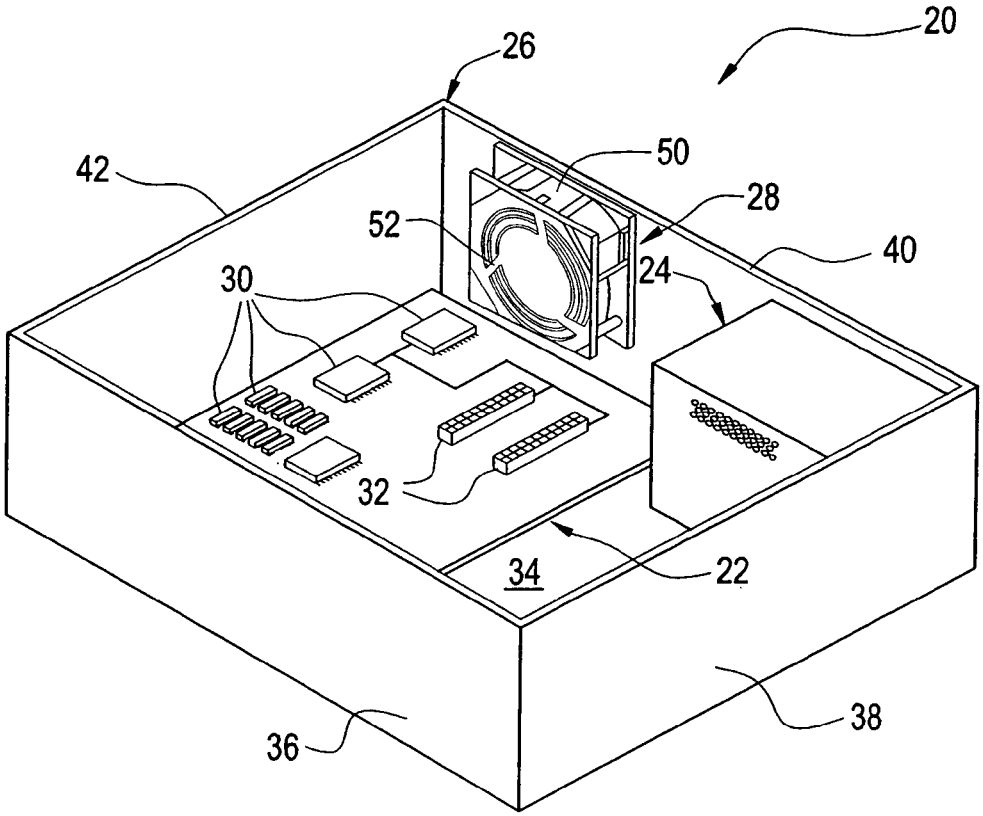
FIG. 1 is a perspective view of a computer enclosure with the top wall removed to reveal a fan having a guard in accordance with one embodiment of the present invention.

FIG. 1 is a perspective view of a computer 20 (shown partially assembled) that employs a fan having a guard according to one embodiment of the present invention. The computer 20 include a printed circuit board 22, a power supply 24, an enclosure 26 and a fan 28. The printed circuit board includes a plurality of integrated circuits 30 and connectors 32. The enclosure 26 includes a base 34 and side walls 36, 38, 40, 42. The fan 28 is mounted in the side wall 40 and produces airflow to cool the internal components (e.g., power supply 24 and printed circuit board 22 including integrated circuits 30 and connectors 32) of the computer 20.

The fan 28 includes a housing 50, a guard 52, and rotor assembly (such as for example, a rotor assembly 70 shown in phantom (FIG. 2)). The housing 50, guard 52, and rotor assembly 70 are further described hereinafter with respect to FIG. 2.

Figure 2:
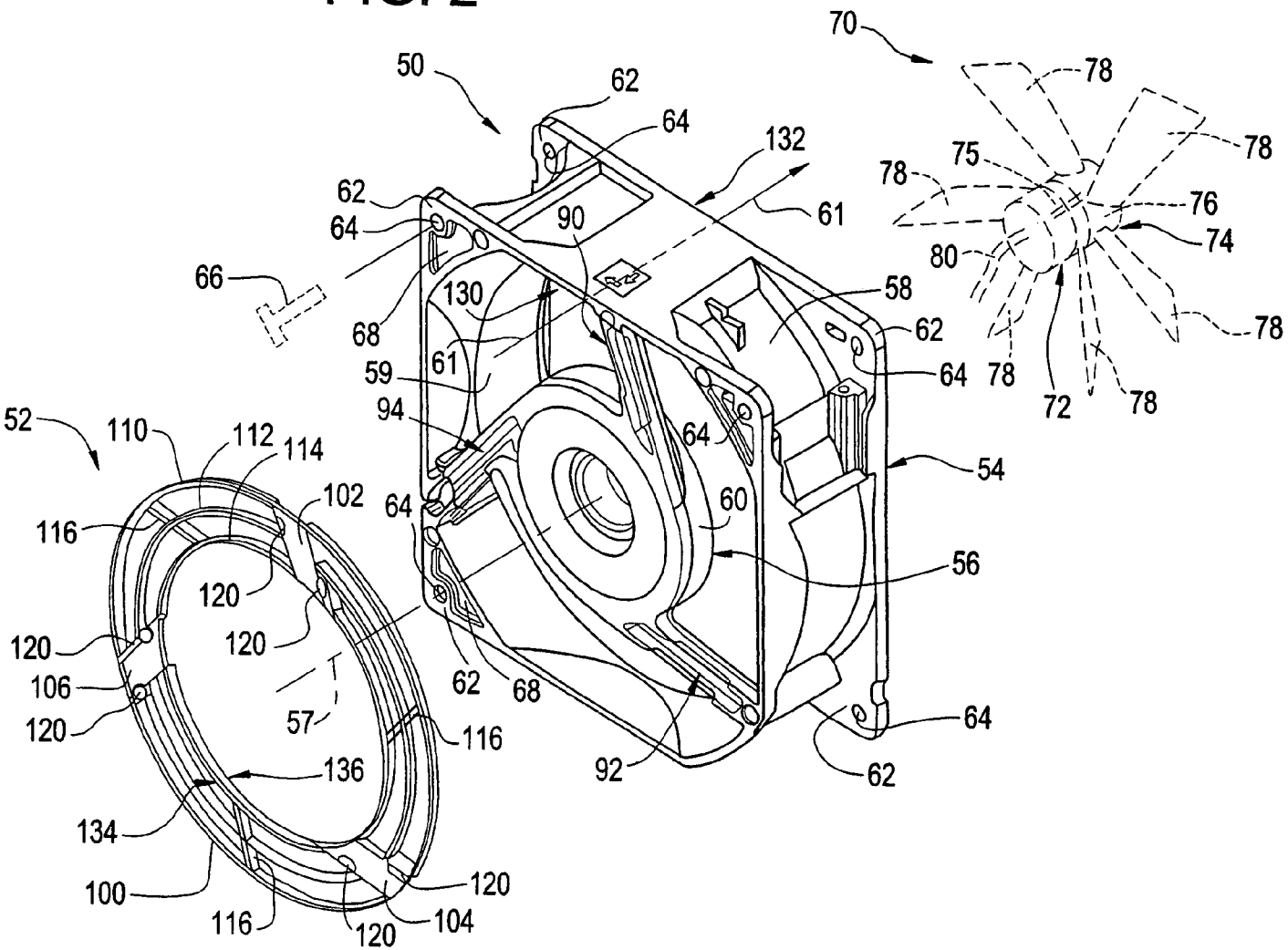
FIG. 2 is an enlarged perspective view of the fan of FIG. 1.

FIG. 2 is an enlarged, partially exploded, perspective view of one embodiment of the housing 50 and guard 52. In this embodiment, the housing 50 includes a casing 54 and a stator 56. The casing 54 and the stator 56 are disposed about a longitudinal axis (or axis of rotation) 57. The casing 54 includes a substantially annular portion 58 (referred to hereafter as "annular portion") having a substantially annular radial inner surface 59. The stator 56 has a substantially annular radial outer surface 60. The radial inner surface 59 of the substantially annular portion 58 and the radial outer surface 60 of the stator 56 generally define a substantially annular flow path 61 therebetween.

The casing 54 further includes flanges 62. Through holes 64 in the flanges 62 are each adapted to receive a fastener, such as, for example, a fastener 66 (shown in phantom), to attach the housing 50 to the enclosure 26 (FIG. 1) or some other structure. The flanges 62 may include stiffeners 68.

The stator 56 is adapted to receive and support a rotor assembly, such as, for example, a rotor assembly 70 (shown in phantom). The illustrated rotor assembly 70 includes a motor 72 and a bladed disk 74. The motor 72 includes a motor shaft 75, which is coupled to and drives the bladed disk 74. The bladed disk 74 is made up of a disk portion 76 and a plurality of blades 78 that extend therefrom.

There is typically at least one electrical wire or wires 80 electrically connected to the motor 72. Electrical wires 80 may, for example, be used to provide electric power to the motor 72.

Figure 4:
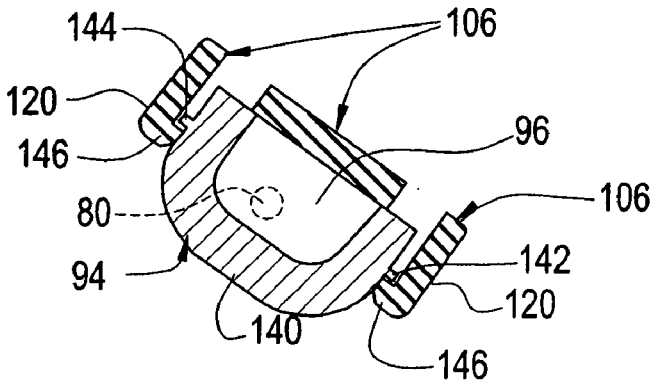
FIG. 4 is a cross-sectional view of the strut and guard of FIG. 3 taken in the direction of L—L.

The housing 50 further includes a plurality of struts 90, 92, 94. The struts 90, 92, 94 extend radially between the casing 54 and the stator 56 to thereby support the stator 56. Strut 94 has a channel 96 (FIG. 4) that extends the length of the strut 94. The electrical wire(s) to be connected to the motor to be mounted in the housing 50 (e.g., electrical wires 80 to/from the motor 72) may be routed through the channel 96 (FIG. 4).

The guard 52 includes a grill 100 and a plurality of clips 102, 104, 106. The grill 100 has three substantially concentric rings (i.e., a first ring 110, a second ring 112, and a third ring 114) and three radially extending members 116. The radially extending members 116 connect the concentric rings 110, 112, 114 to one another. Each of the clips 102, 104, 106 has tabs 120 that extend axially toward the fan housing 50. (Details of the tabs 120 are further described hereinafter with respect to FIGS. 4, 7.) As will be further described hereinafter, the clips 102, 104, 106 are used to mount the guard 52 to the housing 50.

A rear surface of the housing 50 is indicated at 130. A forward surface is indicated at 132. An outer facing surface of the guard 52 is indicated at 134. An inner facing surface is indicated at 136. In the illustrated embodiment of the present invention, the housing 50 is made of either plastic or metal, such as an injection molded plastic or a die cast aluminum. However, as may be recognized by those of ordinary skill in the pertinent art based in the teachings herein, the housing 50 may be made of any of numerous different materials that are currently known or later become known for performing the function of the housing as described herein.

As will be further described hereinafter, the guard 52 is to be snapped onto the housing 50.

Figure 3:
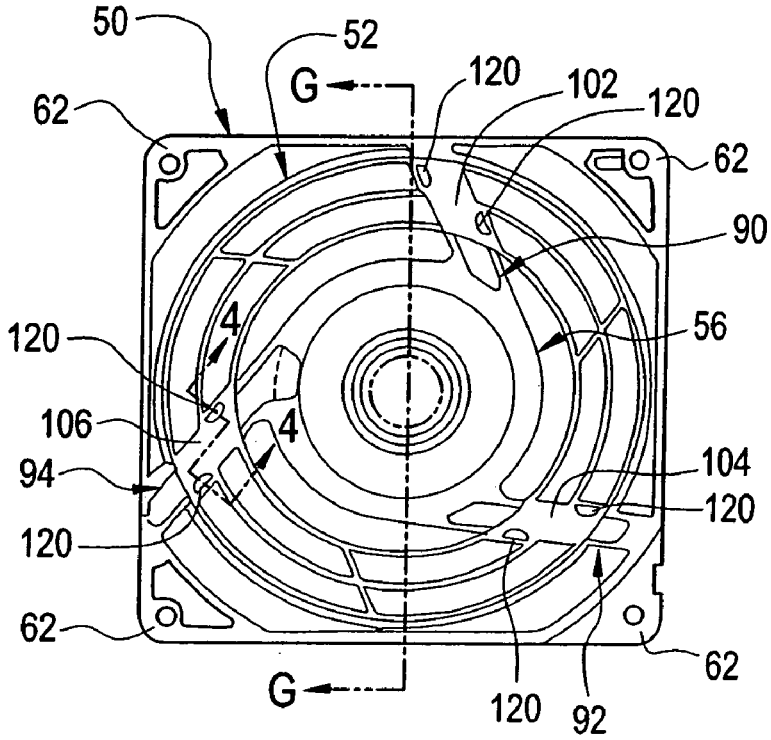
FIG. 3 is a rear elevational view of the fan housing of FIG. 2 with the guard of FIG. 2 assembled thereon.

FIG. 3 shows the guard 52 mounted on the housing 50. In this state, the tabs 120 on the clips 102, 104, 106 engage the struts 90, 92, 94 and thereby retain the guard 52 to the housing 50. Details of the manner in which the tabs 120 engage the struts 90, 92, 94 is further described hereinbelow with respect to FIG. 4.

FIG. 4 is a cross-sectional view of the strut 94 and the clip of FIG. 2 taken in the direction of L—L (FIG. 3). The strut 94 has an outer surface 140 and two shoulders 142, 144. The two shoulders 142, 144 extend radially and/or circumferentially from the outer surface 140 of the strut 94.

As stated above, the clip 104 has tabs 120 that extend axially toward the housing 50. Each of the tabs 120 has a hook 146 that engages a respective shoulder 142, 144 on the strut 94. With the hooks 146 engaging the shoulders 144, 146, as shown, the clip 104 is retained to the strut, thereby retaining the guard 52 to the housing 50.

Note that in some embodiments, the strut may have a recess for seating the clip so that the clip does not reduce the cross sectional area of the flow path.

To assemble the guard 52 onto the housing 50 as shown in FIGS. 3, 4, the guard 52 is first suitably positioned relative to the struts 90, 92, 94 of the housing 50. Force is then applied so as to force the clips 102, 104, 106 onto the struts 90, 92, 94. The tabs on the clips 102, 104, 106 spread apart (i.e., the distance between the tabs on a clip increases) when the hooks reach the front of the shoulders (i.e., the axially rear portion of the shoulders). After the hooks pass the shoulders, the hooks come to rest behind the shoulders (i.e., axially forward of the shoulders), thereby retaining the clips 102, 104, 106 to the struts 90, 92, 94 and retaining the guard 52 to the housing 50.

With the guard 52 mounted on the housing 50, the guard 52 extends across at least a portion of the channel 96 and thereby traps any electrical wires (e.g., electrical wires 80) (FIG. 2) routed through the channel 96.

Figure 5:
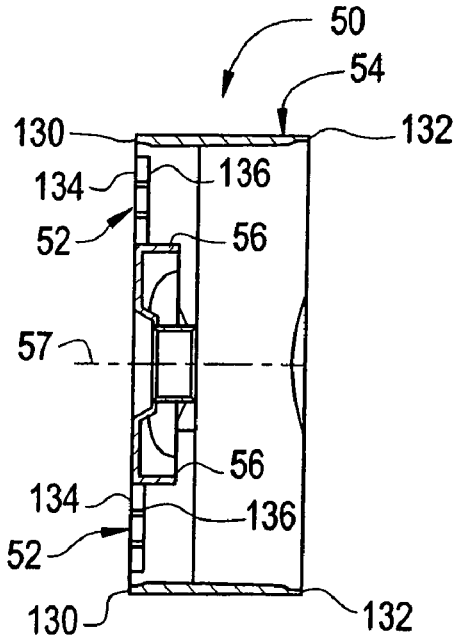
FIG. 5 is a cross-sectional view of the fan housing of FIG. 3 with the guard of FIG. 3 assembled thereon, taken in the direction of G—G.

FIG. 5 is a cross-sectional view of the guard 52 mounted on the housing 50, taken in the direction of G—G (FIG. 3). As can be seen, the outer facing surface 134 of the guard is flush (i.e., substantially coplanar) with the rear surface 130 of the housing. Consequently, the guard 52 does not increase the outer dimensions of the housing 50.

Figure 6:
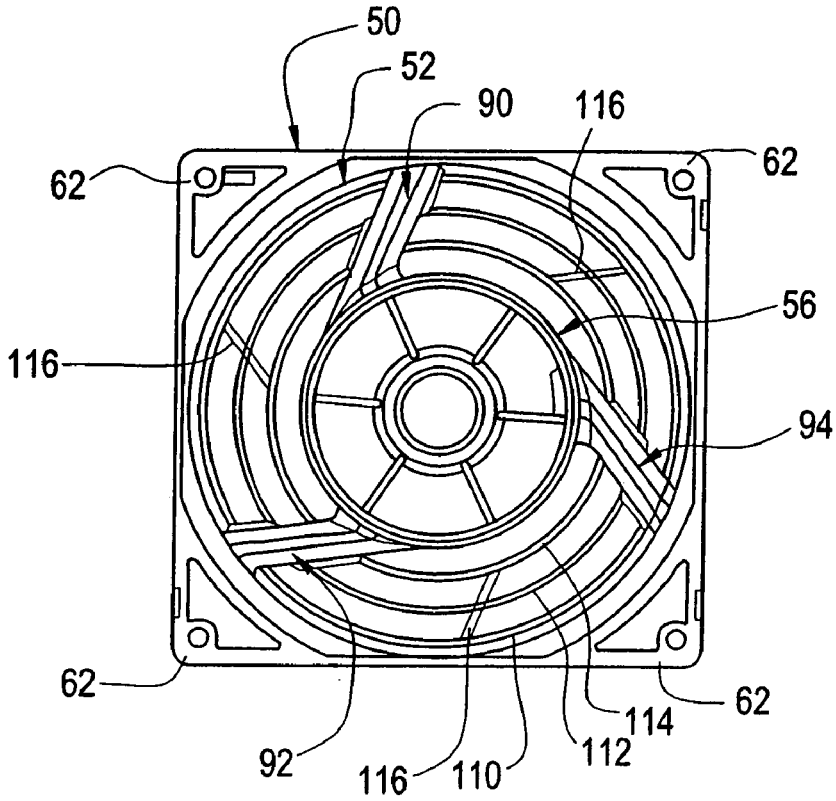
FIG. 6 is a front elevational view of the fan housing of FIG. 3 with the guard of FIG. 3 assembled thereon.

FIG. 6 shows a front elevational view of the housing 50 with the guard 52 mounted thereon.

Figure 7:
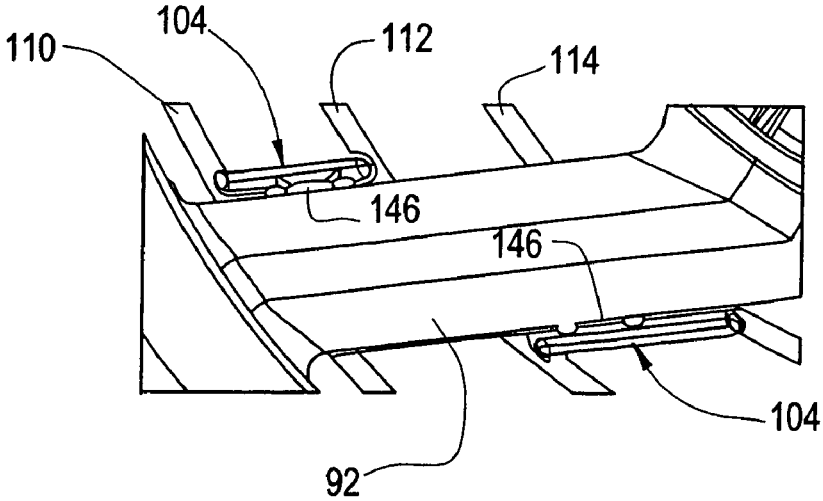
FIG. 7 is an enlarged, front perspective view of a portion of the strut and guard of FIG. 6.

FIG. 7 is an enlarged, front elevational view of a portion of the strut 92 with hooks 146 of clip 104 engaged therewith (see insert P-FIG. 6).

Although the grill portion of the guard described above is substantially annular, this is not required. In addition, even if a grill is substantially annular, it need not comprise concentric rings as shown. For example, in some embodiments, the grill comprises partial rings or annular segments instead of complete rings. The annular segments may collectively form only a portion of a ring. Furthermore, even if a grill comprises complete rings, it need not comprise exactly three concentric rings as shown. For example, in some embodiments, the grill comprises only one or two rings. In some other embodiments, the guard comprises more than three rings.

In addition, although the guard described above has three clips to engage the three struts, there is no requirement to engage each and every strut. Moreover, although the clips have tabs with hooks that engage shoulders on the struts, the present invention is not limited to such. For example, some embodiments may employ clips having barbed studs that engage through holes in the struts. Some other embodiments may employ hooks on the struts. Some other embodiments may employ other types of engagements. Still further embodiments may employ combinations of the above.

Although the fan housing is shown having flanges with a triangle-like shape, such flanges are not required. For example, some embodiments have flanges with non-triangle-like shapes. Some other embodiments may have no flanges at all.

Furthermore, although the struts in the housing extend from the casing to the stator, struts are not limited to such. For example, struts can extend in any direction. Moreover, struts are not limited to the shape shown above.

Although the rear surface of the guard is shown flush with the rear surface of the housing, the present invention is not limited to such. For example, in some embodiments, the guard may not be flush with the housing. Moreover, in some embodiments, the guard may be mounted on the forward side of the housing. In such embodiments, the guard may be flush with the forward surface of the housing, although this is not required.

Note that, except where otherwise stated, phrases such as, for example, "extends radially" mean "extends in a direction that has, but is not limited to, a radial component." Thus, for example, "extends radially" means "extends in a direction that is purely radial" or "in a direction that has a radial component in addition to an axial and/or circumferential component".

Also note that, except where otherwise stated, the term "retain" means "releasably retain" or "permanently retain".

Except where otherwise stated, the phrases such as "wire" or "wires" mean any type of electrical leads including for example, but not limited to, insulated wire(s), trace(s), and/or any combination thereof.

Note that, except where otherwise stated, phrases such as, for example, "connected to" mean "connected directly to" or "connected indirectly to".

Also note that, except where otherwise stated, terms such as, for example, "comprises", "has", "includes", and all forms thereof, are considered open-ended, so as not to preclude additional elements and/or features.

Thus, while there have been shown and described various embodiments, it will be understood by those skilled in the art that the present invention is not limited to such embodiments, which have been presented by way of example only, and that various changes and modifications may be made without departing from the spirit and scope of the invention. Accordingly, the invention is limited only by the appended claims and equivalents thereto.

What is claimed is:

1. An assembly comprising:

a fan housing that includes a casing and stator each of which is disposed about an axis and is radially spaced therefrom, the stator being disposed radially inward of the casing and adapted to receive a rotor assembly, the housing further including a strut that attaches the stator to the casing; and a fan guard including a grill and a clip fixed to the grill and including a mounting surface that engages the strut to retain said fan guard to said strut to help retain the fan guard to the fan housing.

2. The assembly of claim 1 wherein the clip has at least one tab that extends axially and defines the mounting surface that engages the strut and retains the fan guard to the strut.

3. The assembly of claim 2 wherein the strut has at least one shoulder and the tab has at least one hook that engages a respective one of the at least one shoulders.

4. The assembly of claim 3 wherein the strut has a channel that extends radially in a direction from the casing to the stator, the clip has a surface that covers at least a portion of the channel when the clip engages the strut, and the assembly further comprises at least one electrical wire that is routed through the channel and trapped in said channel by said clip.

5. The assembly of claim 1 wherein the strut has a channel that extends radially in a direction from the casing to the stator, and the fan guard has a surface that covers at least a portion of the channel when the fan guard engages the strut.

6. The assembly of claim 5 further comprising at least one electrical wire routed through the channel and trapped in said channel by said fan guard.

7. The assembly of claim 1 wherein the fan guard is substantially annular.

8. The assembly of claim 7 wherein the fan guard comprises at least two substantially concentric rings and at least two radially extending members that connect the at least two substantially concentric rings.

9. The assembly of claim 8 wherein the fan guard comprises at least two concentric rings and at least two radially extending members that connect the at least two concentric rings, the fan housing has a rear surface and a forward surface and the guard has an outer facing surface taht is flush with either of the rear surface and forward surface of the housing.

10. The assembly of claim 1 wherein the fan housing has a rear surface and a forward surface and the guard has an outer facing surface that is flush with either of the rear surface and forward surface of the housing.

11. The assembly of claim 1 wherein one of the fan guard and the strut defines a relatively raised engaging surface and the other defines a relatively recessed engaging surface for receiving the relatively raised engaging surface to thereby secure the fan guard to the strut.

12. An assembly comprising:

a fan housing that includes a stator and a casing each of which is disposed about an axis and is radially spaced therefrom, the stator being disposed radially inward of the casing and adapted to receive a rotor assembly, the housing further including a strut that attaches the stator to the casing; and a fan guard including a grill and means fixed to the grill for clipping the fan guard to the strut and including a mounting surface that engages the strut to help retain the fan guard to the fan housing.

13. The assembly of claim 12, wherein said means is defined by a clip including the mounting surface that engages the strut.

14. The assembly of claim 13, wherein the clip defines at least one relatively raised mounting surface, and the strut includes at least one shoulder defining at least one relatively recessed surface for receiving the relatively raised mounting surface and thereby securing the fan guard to the strut.

15. A method for use in association with a fan housing that includes a stator and a casing each of which is disposed about an axis and is radially spaced therefrom, the stator being disposed radially inward of the casing and adapted to receive a rotor assembly, the housing further including a strut that attaches the stator to the casing, the method comprising:

providing a fan guard including a grill and a clip fixed to the grill and including a mounting surface that engages the strut; and retaining the fan guard to the strut by engaging the clip to the strut.

16. An assembly comprising:

a fan housing that includes a stator and a casing each of which is disposed about an axis and is radially spaced therefrom, the stator being disposed radially inward of the casing and adapted to receive a rotor assembly, the housing further including a strut having a radially extending channel;

a fan guard including a grill and a clip fixed to the grill and including a mounting surface that engages the strut to mount the fan guard to the fan housing, the fan guard including a surface that covers at least a portion of the channel when the fan guard is mounted to the fan housing; and at least one electrical wire routed through the channel and trapped in said channel by said fan guard.

17. The assembly of claim 16 wherein the fan guard is substantially annular.

18. The assembly of claim 16 wherein the fan guard comprises at least two substantially concentric zings and at least two radially extending members that connect the at least two substantially concentric rings.

19. The assembly of claim 18 wherein the strut extends radially and attaches to stator to the casing.

20. The assembly of claim 16 wherein the strut extends radially and attaches the stator to the casing.

21. An assembly comprising:

a fan housing that includes a stator and a casing each of which is disposed about an axis and is radially spaced therefrom, the stator being disposed radially inward of the casing and adapted to receive a rotor assembly, the housing further including a strut having a radially extending channel;

at least one electrical wire routed through the channel; and a fan guard including a grill and a clip fixed to the grill and including a mounting surface that engage the strut to mount the fan guard to the fan housing, the fan guard having means for covering at least a portion of the channel when the fan guard is mounted to the fan housing to trap said electrical wire in said channel.

22. The assembly of claim 21, wherein said means is defined by the clip.

23. A method comprising:

providing a fan housing that includes a stator and a casing each of which is disposed about an axis and is radially spaced therefrom, the stator being disposed radially inward of the casing and adapted to receive a rotor assembly, the housing further including a stint having a radially extending channel;

routing at least one electrical wire through the channel;

providing a fan guard including a grill and a clip fixed to the grill and including a mounting surface that engages the strut; and retaining the fan guard to the strut by engaging the clip to the strut and covering at least a portion of the channel with the fan guard to thereby trap said electrical wire in said channel.

24. A fan guard mountable on a fan assembly having a housing that includes a stator and a casing each of which is disposed about an axis and is radially spaced therefrom, the stator being disposed radially inward of the casing and adapted to receive a rotor assembly, the housing further including a strut that attaches the stator to the casing, the fan guard comprising:

a grill having an axis; and a clip that attaches to the grill and extends radially, wherein the clip includes a mounting surface that engages the strut to retain the guard to said strut.

25. The fan guard of claim 24 wherein the clip further includes at least two tabs that extend axially, each of the at least two tabs having a hook that engages the strut and retains the clip to the strut.

26. The fan guard of claim 25 wherein the strut has two shoulders and the hook of each tab engages an associated one of the shoulders of the strut.

27. The fan guard of claim 24 wherein the strut has a channel that extends radially from the easing to the stator, and the clip has a surface that covers at least a portion of the channel when the clip engages the strut.

* * * * *